United States Patent [19]

Chan

[11] Patent Number: 4,771,823

[45] Date of Patent: Sep. 20, 1988

[54] SELF-ACTUATING HEAT SWITCHES FOR REDUNDANT REFRIGERATION SYSTEMS

[75] Inventor: Chung K. Chan, Los Angeles, Calif.

[73] Assignee: The United States of America as represented by the Administrator of the National Aeronautics and Space Administration, Washington, D.C.

[21] Appl. No.: 87,282

[22] Filed: Aug. 20, 1987

[51] Int. Cl.[4] ..... F28F 27/00; F25B 19/00

[52] U.S. Cl. ..... 165/61; 62/467; 62/514 R; 165/96

[58] Field of Search ..... 62/514 R, 467, 56, 175; 165/32, 96, 61

[56] References Cited

U.S. PATENT DOCUMENTS

| | | | |
|---|---|---|---|
| 2,735,907 | 2/1956 | Inman | 200/61.05 |
| 3,916,367 | 10/1975 | Nicholas et al. | 338/35 |
| 4,111,002 | 9/1978 | Van Mal et al. | 62/467 R |
| 4,366,680 | 1/1983 | Tward | 62/514 R |
| 4,689,970 | 9/1987 | Ohguma et al. | 62/514 R |

FOREIGN PATENT DOCUMENTS

| | | | |
|---|---|---|---|
| 0800581 | 1/1981 | U.S.S.R. | 165/96 HV |

*Primary Examiner*—William E. Wayner
*Attorney, Agent, or Firm*—Thomas H. Jones; John R. Manning; Paul F. McCaul

[57] ABSTRACT

A dual refrigeration system for cooling a sink device is described, which automatically thermally couples the cold refrigerator to the sink device while thermally isolating the warm refrigerator from the sink device. The system includes two gas gap heat switches that each thermally couples one of the refrigerators to the sink device, and a pair of sorption pumps that are coupled through tubes to the heat switches. When the first refrigerator (18) is operated and therfore cold, the first pump (50) which is thermally coupled thereto is also cooled and adsorbs gas to withdraw it from the second heat switch (44), to thereby thermally isolate the sink device (12) from the warm second refrigerator (26). With the second refrigerator being warm, the second pump (52) is also warm and desorbs gas, so the gas lies in the first switch (38), to close that switch and therefore thermally couple the cold first refrigerator (18) to the sink device. Thus, the heat switches are automatically switched according to the temperature of the corresponding refrigerator.

6 Claims, 2 Drawing Sheets

FIG. 1
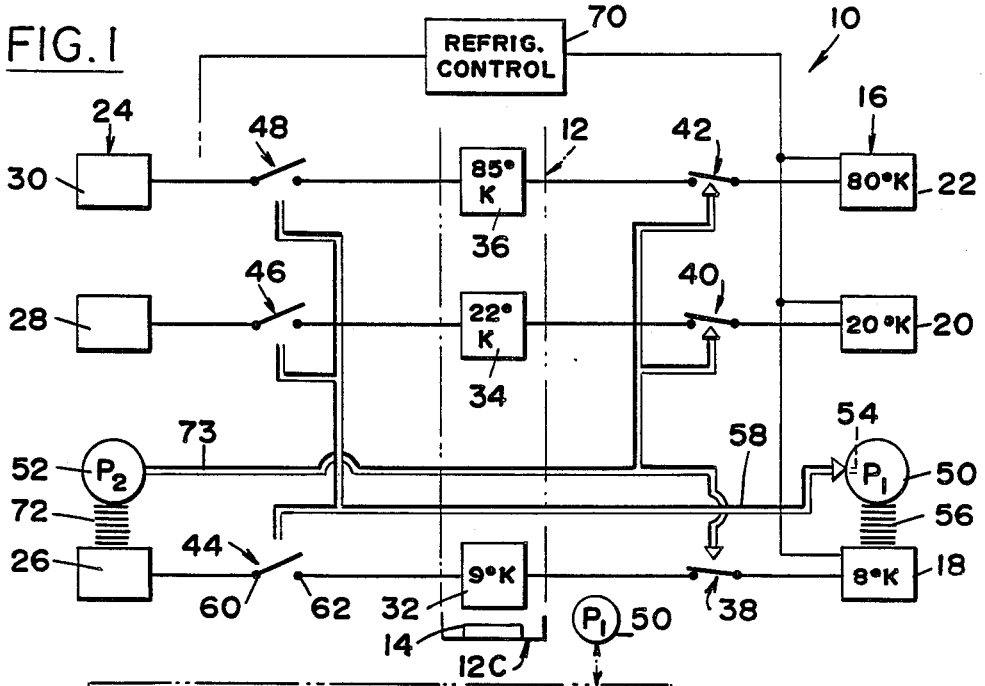
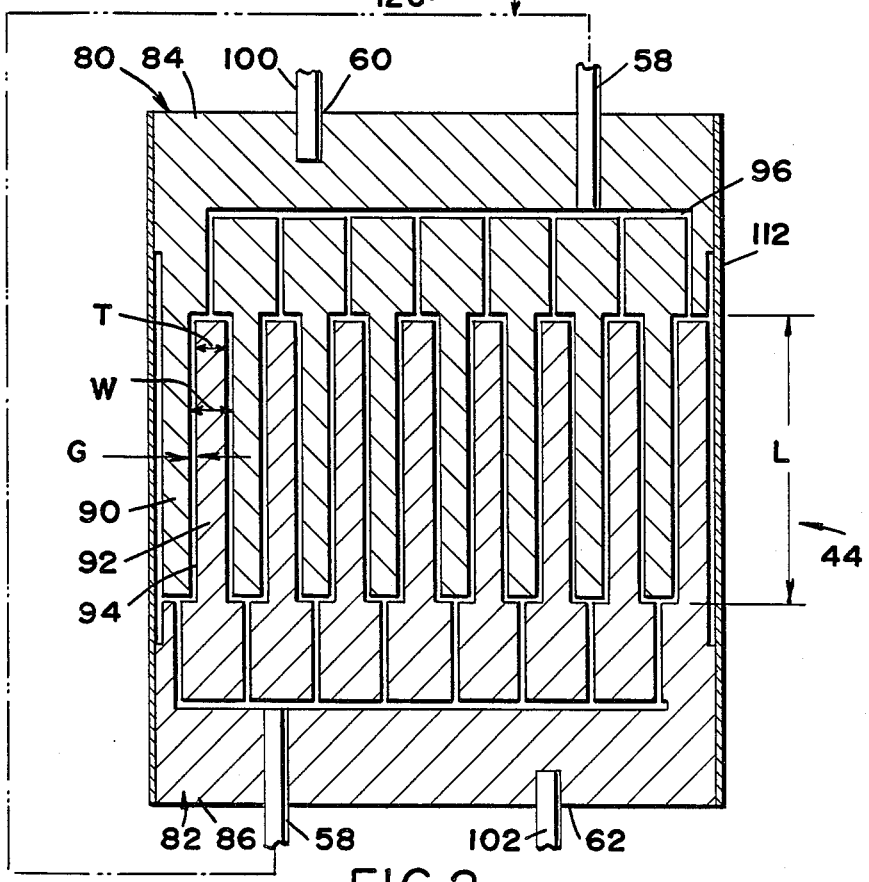
FIG. 2

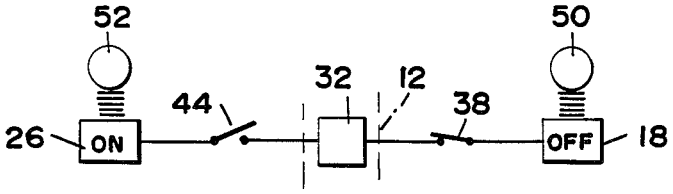
FIG.5
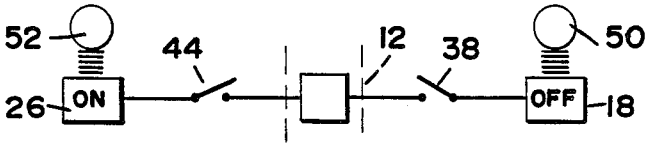
FIG.6
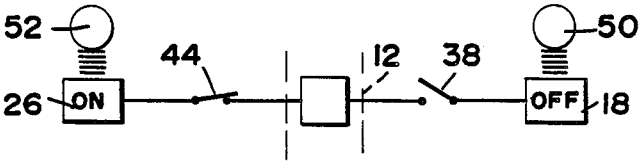
FIG.7
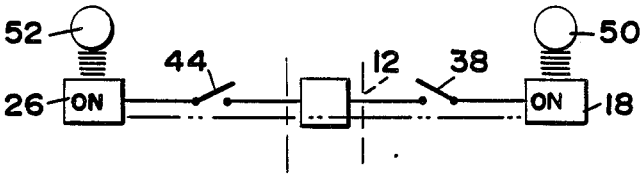
FIG.8
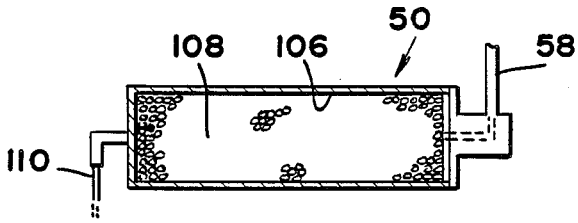
FIG.4
FIG.3
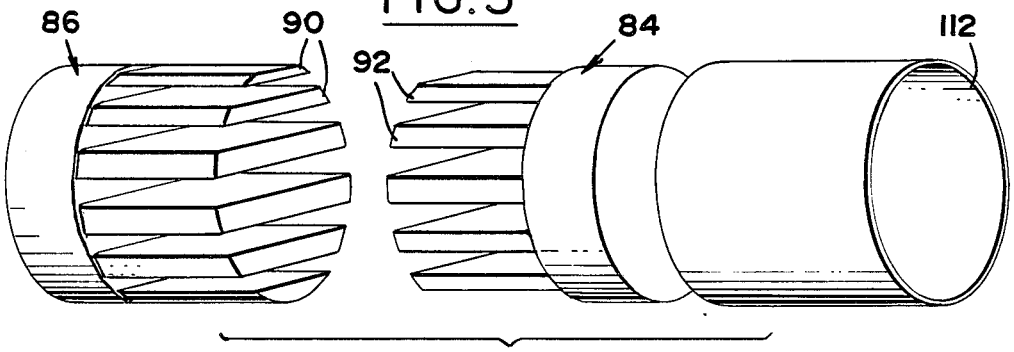

SELF-ACTUATING HEAT SWITCHES FOR REDUNDANT REFRIGERATION SYSTEMS

ORIGIN OF THE INVENTION

The invention described herein was made in the performance of work under a NASA contract, and is subject to the provisions of Public Law 96-517 (35 USC 202) in which the Contractor has elected not to retain title.

BACKGROUND OF THE INVENTION

Space vehicles often carry sensors that must be kept very cold, and the lifetime of the sensors is often limited by the cryocooler, or low-temperature refrigerator. For example, the useful life of far-infrared sensors on surveillance satellites, which are maintained at a temperature of about 10° K., is presently limited by the lifetime of the cryocooler. The useful life of the cooling system can be extended by using redundant cryocoolers, with a first cryocooler thermally coupled to the sensor and the inactive backup cryocooler thermally isolated therefrom until needed. Heat switches for establishing such thermal connection or isolation have not been of high efficiency or high reliability. Reliable operation may be required over extended periods of time, such as a minimum of five to ten years. Mechanically actuated heat switches have been proven unreliable at cryogenic temperatures and further require large contact force. Magneto-resistive heat switches are, except at very low temperatures, of very low efficiency. Heat switches operated by the heat pipe principle usually require a long response time. Gas gap heat switches, such as described in U.S. Pat. No. 4,366,680 can provide reliable thermal connection and isolation, except that they have previously required heating or cooling coils to control the temperature of the sorption pumps that operate the heat switches, and also require control and power sources for operating such heating or cooling coils. Prior gas gap heat switches such as described in U.S. Pat. No. 4,366,680 had low heat transfer capacity and low heat switch ratios. A redundant refrigeration system which enabled the use of gas gap heat switches, and which provided efficient switches of that type, while avoiding the previous disadvantages in the use of such heat switches, would be of considerable value.

SUMMARY OF THE INVENTION

In accordance with one embodiment of the present invention, a rendundant refrigeration system is provided, which enables reliable long-term thermal switching between a sink device to be cooled and each of a plurality of refrigerators which are to be alternately operated. The system can include first and second gas gap heat switches (38, 44) that each can thermally couple a different one of two refrigerators (18, 26) to the sink device (12). A first sorption pump (50) is thermally coupled to the first refrigerator, and is coupled through a conduit (58) to the second heat switch. Similarly, a second sorption pump (52) is thermally coupled to the second refrigerator and coupled through a conduit to the first heat switch (38). When the first refrigerator is cold while the second is warm, the first sorption pump (50) is cold and draws out gas from the second switch (44) to thereby isolate the warm second refrigerator from the sink device. At the same time, the second pump (52) is warm so it desorbs gas that closes the first heat switch (38), to thermally couple the first refrigerator to the sink device. If the first refrigerator fails and the second refrigerator is placed in operation, the necessary switching to thermally couple the second refrigerator to the sink device and uncouple the first refrigerator therefrom, will be automatically accomplished.

Each gas gap heat switch includes two thermally conductive elements (82, 84) having a plurality of parallel fins (90, 92) that are held in an interfitting relationship, but with the fins out of contact except through gas that may lie in the spaces between the fins.

The novel features of the invention are set forth with particularity in the appended claims. The invention will be best understood from the following description when read in conjunction with the accompanying drawings.

BRIEF DESCRIPTION OF THE DRAWINGS:

FIG. 1 is a diagrammatic view of a dual refrigeration system constructed in accordance with one embodiment of the present invention.

FIG. 2 is a sectional view of a heat switch useful in the system of FIG. 1, and constructed in accordance with the present invention.

FIG. 3 is an exploded perspective view of the switch of FIG. 2.

FIG. 4 is a sectional view of a sorption pump useful in the system of FIG. 1.

FIG. 5 illustrates a portion of the system of FIG. 1, when the first refrigerator is just deenergized and cold and the second is energized and warm.

FIG. 6 is a view similar to that of FIG. 5, but wherein both refrigerators are cold.

FIG. 7 is a view similar to that of FIG. 5, but with the second refrigerator cold and the first one warm.

FIG. 8 is a view similar to that of FIG. 5, but showing a condition wherein both refrigerators are temporarily cold.

DESCRIPTION OF THE PREFERRED EMBODIMENTS:

FIG. 1 illustrates a dual refrigeration system 10 for maintaining a cold sink device 12 at a low temperature, with the coldest end 12C of the device at a very low temperature such as 9° K. at which an infrared sensor 14 is highly sensitive. The system includes two sets of refrigerators, including a first set 16 that includes three refrigerators 18–22, and a second set 24 which includes three refrigerators 26–30. It may be noted that either one refrigerator with three stages, or three separate refrigerators may be used; whenever the term "refrigerator" is used, this term may refer to a stage. Each set of refrigerators such as 16 is shown as including three refrigerators or stages which, when operating, maintain temperatures of 8° K., 20° K., and 80° K., respectively. When the refrigerators of the first set 16 are operating and therefore cold, each is thermally coupled through a corresponding closed heat switch 38–42 to a corresponding location 32–36 on the sink device. At that time, the second set of refrigerators 24 are all nonoperating and therefore warm, and the corresponding heat switches 44–48 are all open to thermally isolate the warm refrigerators from the sink device.

The heat switches 38–48 are of a type which includes two conductors with a small gap between them which can either be filled with gas (i.e., containing gas at an appreciable pressure) which conducts heat across the gap or which can be substantially devoid of gas (i.e., containing gas at a low pressure) so there is little flow of heat across the gap. The heat switches are controlled by sorption, or adsorption, pumps 50, 52 which adsorb gas when cold, to thereby draw in gas into their passages (54), and which desorb gas when warmed to thereby release gas to flow out of their passages.

The first sorption pump 50 is thermally coupled along the thermal path indicated at 56 to the first refrigerator 18, so when the first refrigerator is cold, the first heat pump 50 adsorbs gas. The first heat pump is coupled through a conduit or tube 58 to each of the second heat switches 44–48. When the first pump 50 is cold, it draws gas out of the second switches 44–48, which causes such second switches to be opened so they do not conduct heat well across their opposite ends 60, 62. Thus, when the first refrigerator 18 is cold, the first pump 50 is also cold and adsorbs gas, which causes the second heat switch 44 to be open. Such opening of the switch 44 is important to assure that "coldness" is not lost by passage of large amounts of heat from the warm refrigerator 26 through the switch 44 to the sink device. The other refrigerators and switches, for the 20° K. and the 80° K. temperatures, operate in a similar manner.

If one of the first refrigerators 16 should stop operating properly, a control circuit 70 switches electricity from the first set of refrigerators 16 to the second set 24. The second set of refrigerators 24 then become cold while the first set 16 becomes warm as its temperatures rise towards the ambient temperature. As the temperature of the second refrigerator 26 decreases, the temperature of the second pump 52 also decreases because it is thermally connected through a thermal path 72 to the second refrigerator. As the second pump becomes cold, it begins to adsorb gas, thereby drawing gas through conduit 73 away from the first heat switches 38–42, and thereby opening the heat switches 38–42. When the first heat switches such as 38 are opened, they isolate the sink device 12 from the first refrigerator such as 18, to reduce unnecessary heat gain. As the first refrigerator 18 becomes warmer, the first pump 50 thermally coupled thereto also becomes warmer and starts to desorb gas. Such desorbed gas passes through conduit 58 to the second heat switches such as 44 to close those switches and thermally couple the second refrigerators 24 to the sink device.

FIGS. 2 and 3 illustrate a gas gap heat switch such as 44, whose opposite ends 60, 62 can thermally couple or isolate the sink device from a refrigerator. The heat switch includes first and second thermally conductive elements 80, 82 that each includes a base 84, 86 and a plurality of fins 90, 92 projecting from the corresponding base. The fins of the two elements are interleaved, but out of direct contact, to leave thin gaps 94 (less than 0.01 inch thick, but preferably 0.002 inch thick or less) between them. When the gaps 94 are occupied by thermally conductive gas at a substantial pressure, considerable heat can be passed through the gap to thermally couple the elements and therefore the opposite ends 60, 62 of the switch. When the gas pressure is very low, the heat conductivity is also very low. The gaps are part of passages 96 that are coupled to the tube or conduit 58 that carries gas between the heat switch and the corresponding heat pump 50. A pair of metal straps 100, 102 thermally couple the opposite ends 60, 62 of the heat switch respectively to the second refrigerator and the sink device.

FIG. 4 shows the first heat pump 50 which includes a chamber 106 filled with a fluid-adsorbing material 108 such as charcoal which can adsorb a variety of suitable fluids such as helium gas, hydrogen gas, nitrogen gas, and neon gas. The charcoal material is bonded onto the chamber wall by indium or epoxy for heat transfer enhancement. The heat pump 50 is thermally coupled by a silver wire 110 to the first refrigerator 18 so that the heat pump is maintained at about the same temperature as the first refrigerator 18. With helium as the gas, the amount of helium gas in the fluid-carrying volume coupled to pump 18 is of an amount that allows the charcoal in the pump to adsorb sufficient gas to leave a pressure of only about $10^{-6}$ torr or less when the charcoal is at 9° K. The pressure of the gas rises at increasing charcoal temperatures, until the pressure may be about 100 torr (sufficient for high thermal conductivity) at a charcoal temperature of 40° K. The pressure required for good thermal conductivity varies with the gas, the temperature, and the gap size. In almost all situations a pressure above 1 torr is required for good conductivity.

Referring again to FIGS. 2 and 3, it can be seen that the width W of the spaces between fins of the first element 80 are greater than the thickness T of the fins of the second element. A ring 112 of material having a low thermal conductivity such as stainless steel, encircles base portions of the cylindrical elements, to hold it in alignment. In one heat switch constructed as shown in FIGS. 2 and 3, with the elements 80, 82 of copper, each element had a diameter of 2 inches, the fins had a thickness T of 0.125 inch and a length L of 1.0 inches, and the gap thickness G was 0.002 inch. The ring 112 had a thickness of 0.002 inch. The conductance ratio, which is the conductance when the switch is filled with gas (such as helium at a pressure of 100 torr) divided by the conductance when the switch contains gas at a low pressure (such as $10^{-6}$ torr), was about 10,000. Gold plated fins and a thinner ring 112 will further increase the switch ratio. This may be compared with the ratio of prior art switches such as shown in U.S. pat. No. 4,366,680 of about 200.

FIGS. 5–8 illustrate a portion of the system of FIG. 1, at times shortly after turn off of the first set of refrigerators 16 and energization of the second set of refrigerators 24. Initially, although refrigerator 18 is off, it and pump 50 are still cold, so switch 44 remains open, and the second refrigerator 46 and its pump 52 are still warm and the first switch 38 remains closed.

FIG. 6 illustrates the condition where the second refrigerator 26 and second pump 52 have been cooled down sufficiently so that the first switch 38 is opened. Cooling of the second refrigerator when it is turned on occurs more rapidly than heating of the first refrigerator 18 when it is turned off, so the situation in FIG. 6 exists for a short period of time. During operation in FIG. 6, the heat device 12 is isolated from both refrigerators, and its temperature rises slowly due to heat gain from the environment.

FIG. 7 illustrates the situation when the first refrigerator and first heat pump 18, 50 have warmed sufficiently that the second switch 44 is closed, so that the second refrigerator can begin cooling the sink device. In one system designed for infrared sensors on a surveillance satellite, it is estimated that the period required for the turned off refrigerator 18 to heat to a temperature at which the second switch 44 is substantially closed is about eight hours, and the condition of FIG. 6 where both switches are open occurs for a period of about three to four hours. The heat capacity of the sink device is sufficient to keep the infrared sensors operating during this period of about three to four hours. This period of time is very short in comparison with the useful life of perhaps five to ten years or more of the entire system.

Volatiles can be eliminated from optical elements on the sink device 12, by heating the sink device to a high temperature at which the volatiles are driven off. During such times, both refrigerators 18, 26 can be operated, as shown in FIG. 8, to keep their corresponding pumps 50, 52 cold to keep both switches open.

Thus, the invention provides a system with a plurality of refrigerators such as two wherein the second is to serve as a back up for the first, which automatically thermally couples the cold refrigerator to a sink device while thermally isolating the warm refrigerator therefrom. The system includes a pair of gas gap heat switches that each receives and discharges fluid and that each has a high thermal conductivity only when a substantial amount of fluid is present, and a pair of sorption pumps that are coupled through tubes or conduits to the switches. A first sorption pump that is thermally coupled to a first refrigerator is coupled through a conduit to the second switch which lies between the heat sink and second refrigerator, to open the second switch when the first refrigerator is cold. Similarly, a first switch which couples the first refrigerator to the sink device is coupled through a conduit to the second pump. The heat switches can each be constructed of elements having multiple interleaved fins that are out of contact and which have thin gaps between them, into which gas can be pumped in or out.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A system for coupling a cold one of two refrigerators to a sink device that is to be kept cold, while thermally disconnecting the warm one of the two refrigerators from the device, comprising:

first and second heat switches that each can receive and discharge a heat conducting fluid and that each has a high thermal conductivity when a large amount of fluid is present in the switch and a low thermal conductivity less than said high conductivity when only a small amount of said fluid that is less than said large amount is present in the switch;

first and second sorption pumps that each adsorbs said fluid when the pump is at a cold temperature and which adsorbs less fluid to thereby enable release of the fluid when the pump is at a warm temperature above said cold temperature;

first and second means for coupling said sink device to said first and second refrigerators respectively through said first and second heat switches;

third and fourth means for thermally coupling said first and second pumps respectively to a first and second of said refrigerators;

fifth means for carrying said fluid between said first pump and said second switch;

sixth means for carrying said fluid between said second pump and said first switch.

2. The system described in claim 1 wherein:

said first heat switch comprises first and second thermally conductive elements, each having a base and a plurality of parallel fins projecting from the base, the spaces between the fins of said first element being greater than the thickness of the fins of said second element, and including means for holding said elements adjacent to each other with said fins of said first and second elements interleaved but out of direct contact with each other to leave thin gaps between them;

said first heat switch also including walls forming passages leading to said gaps;

said sixth means comprises a conduit extending between said passages of said first heat switch and said second pump.

3. The system described in claim 1 wherein:

said sink device has locations of different temperatures, said first and second refrigerators being coupled through said switch to a first sink location of low temperature, and said system includes additional first and additional second refrigerators and additional first and second heat switches respectively coupling said additional first and second refrigerators to a second sink location which has a higher temperature than said first location;

said fifth means also carries fluid between said first pump and said additional second switch;

said sixth means also carries fluid between said second pump and said additional first switch.

4. A method for use with a dual refrigeration system which includes first and second refrigerators that are to be alternately thermally coupled to a sink device which is to be kept cold, so that when one refrigerator is cold and the other warm, the cold refrigerator is thermally coupled to the sink device and the warm one is thermally isolated from the sink device, comprising:

establishing first and second heat switches that thermally couple said sink device respectively to said first and second refrigerators, wherein each switch is a gas gap switch that has a passage that can receive and discharge gas and wherein each switch is closed to conduct heat when it has received gas and is opened to not conduct heat when it has discharged most of the gas that was received;

establishing first and second gas pumps that each has a passage that is connected to one of said switches, each pump constructed to receive and discharge gas when respectively heated and cooled;

thermally coupling said first gas pump to said first refrigerator, and coupling the passages of said first pump and second heat switch to allow gas to pass between them;

thermally coupling said second gas pump to said second refrigerator, and coupling the passages of said second pump and first heat switch to allow gas to pass between them.

5. The method described in claim 4 wherein:

said sink device comprises an optical device; and means for heating said optical device to vaporize contaminants, while operating both said first and second refrigerators to open both said first and second switches.

6. A system comprising:

first gas heat switch having first and second elements formed of high thermal conductivity material, each element having a base and a plurality of parallel fins extending from the base, means for holding said elements with said fins interleaved but out of contact, with gaps between said fins being less than 0.01 inch thick, and with the length of interleaving being a plurality of times greater than the width of said fins, and means forming a passage for carrying fluid into and out of said gaps;

a second gas heat switch which is substantially identical to said first mentioned heat switch;

first and second refrigerators;

first and second adsorption pumps, respectively coupled to the passages of said second and first switches to carry fluid between each pump and a corresponding switch, said first and second pumps respectively thermally coupled to said first and second switches.

a sink device which is to be kept cold;

the first and second elements of said first switch being thermally coupled respectively to said first refrigerator and said sink device, and the first and second elements of said second switch being thermally coupled respectively to said second refrigerator and said sink device.

* * * * *